US005123408A

United States Patent [19]

Gaines

[11] Patent Number: 5,123,408

[45] Date of Patent: Jun. 23, 1992

[54] SPORTS HELMET BRACED FOR PROTECTION OF THE CERVICAL SPINE

[76] Inventor: Leonard F. Gaines, P.O. Box 541, Carthidge, Miss. 39051

[21] Appl. No.: 762,541

[22] Filed: Sep. 18, 1991

[51] Int. Cl.[5] ..... A61F 5/04; A61F 5/02; A41D 13/00; A63B 71/10

[52] U.S. Cl. ..... 602/17; 2/2; 2/425; 602/18

[58] Field of Search ..... 128/87 B, 78, DIG. 23; 2/2, 410, 411, 415, 416, 418, 421, 425; D29/15

[56] References Cited

U.S. PATENT DOCUMENTS

| | | | |
|---|---|---|---|
| 2,898,596 | 8/1959 | Keen | 2/425 |
| 2,901,750 | 9/1959 | McMurry | 2/415 |
| 3,134,106 | 5/1964 | Shaffer | 2/425 |
| 3,139,623 | 7/1964 | Joseph, Jr. | 2/415 |
| 3,189,917 | 6/1965 | Sims | 2/415 |
| 3,230,544 | 1/1966 | Mager | 2/415 |
| 3,628,191 | 12/1971 | Douglas | 2/425 |
| 3,818,509 | 6/1974 | Romo | 2/425 |
| 3,900,896 | 8/1975 | Ackerman | 2/425 |
| 3,953,892 | 5/1976 | Kennedy | 2/425 |
| 3,957,040 | 5/1976 | Calabrese | 128/87 B |
| 5,003,968 | 4/1991 | Mars | 128/87 B |

*Primary Examiner*—Robert A. Hafer
*Assistant Examiner*—Michael Brown

[57] ABSTRACT

A flexible support brace transfers excessive back motion of a sports helmet through a flexible interlinked brace, which floats freely between two spaced circumferential spans on the helmet during normal play but which engage with the helmet and collapses to a braced configuration if the helmet is excessively pulled back or pushed forward. In the braced configuration, helmet loads are transferred to the shoulder pads of the player directly thus transferring excessive head loads into the chest area of the player where they can be more safely absorbed.

13 Claims, 3 Drawing Sheets

SPORTS HELMET BRACED FOR PROTECTION OF THE CERVICAL SPINE

BACKGROUND OF THE INVENTION

It has been known in contact sports, especially football, that the impacts are dangerous to the participants, especially young people still in stages of bone growth. Thus it has been common to provide various protective equipments for football players and the like including padding and especially including impact protective helmets to protect the head and skull area from impact injuries. While such helmets have been significant in reducing direct impact injuries from blows to the head, the current style of rigid helmet with face guard has introduced an increased risk of paralyzing injury. This is because the rigid helmet and rigid face guard, which are braced to prevent direct impact injury to the face area and head, result in the transfer of all forces to the head as a body. The head and skull being encased within a padded helmet is securely gripped by the helmet and any force applied to the helmet moves the entire head and is concentrated in the cervical region of the spine.

Thus, since the invention and widespread use of rigid football helmets and face guards especially in high school and some college use with relatively unconditioned or unskilled players, has resulted in an increasing incidence of broken necks and cervical injuries.

It has been determined that these injuries are principally of the type involving compression fractures to the cervical region of the spine when the head is brought back suddenly either by a grip or blow on the helmet forcing it backwards or as a whipping action when the head is sprung into sudden flexion and extension forward and then rebounds backwards. The compression forces are sufficient to overcome the padding effect of spinal discs and concentrate in the cervical region of the spine thus creating the maximum risk of totally paralyzing injury or death.

Many prior art patents have attempted to reduce the risk of neck injuries from helmet motions.

U.S. Pat. No. 3,900,896 to Ackerman discloses a rigid support member fastened between the back of the helmet and the shoulder pads of a football athlete. The member is pivoted for rotation around a vertical axis at the point of attachment to the shoulder pads and this is the only concession to motion.

U.S. Pat. No. 3,818,509 to Romo and others discloses an elastic strap fastened to the bottom end of the shoulder pads or a body harness and in an upper end to the helmet to prevent injuries when the head is snapped forward.

U.S. Pat. No. 3,852,821 to Mickel discloses an impact absorbing pad fastened to the rear of a helmet shell to prevent or absorb an impact from a blow to the rear of the helmet shell and ameliorate the effects of the helmet shell being driven into the rear of the neck. The specific helmet cited is that of a combat infantry helmet for paratroopers.

U.S. Pat. No. 3,591,863 to Rickard discloses a variation on this in which as part of a safety helmet, an elongate vertically extending neck pad is engaged against the back of the wearer's neck. The particular shape of the neck pad is claimed to limit concentration of forces from a backward tilting of the helmet, preventing the force from being concentrated onto the upper portion of the cervical vertebrae.

U.S. Pat. No. 3,103,014 to Morgan discloses a flexible protective sheath having a padded inner surface mounted to the rear of the helmet, bearing against the neck.

U.S. Pat. No. 4,319,362 to Ettinger discloses protective padding for suspension beneath the front and the rear of the helmet. The rear padding is suspended so as to be captured between the back of the helmet and the shoulder pads, preventing excessive tilting back of the helmet.

U.S. Pat. No. 3,139,623 to Joseph discloses mounting the back portion of a football helmet by means of hinges and flexible straps so that if the helmet is forced back on the head the rear of the helmet yields instead of rigidly contacting the neck.

U.S. Pat. No. 3,230,544 to Mager discloses an alternate form of give away flap on the rear of a football helmet for preventing impacting of the helmet into the back of the neck U.S. Pat. No. 3,609,763 to Raney discloses a form of neck guard in a full coverage safety helmet in which the portion of the opening of the rear of the helmet is made not of a rigid material but of a resilient padded flexible material which gives in the event of a backward force upon the helmet.

The prior art known to the inventor is of two types. One fastens the helmet so rigidly to a support structure that safe and effective play is not possible due to restrictions on the player's head motion, and thus to his vision and responsiveness. The other attempts to spread the impact loading over the surface of the neck, but does not reduce the total impact forces on the cervical spine.

SUMMARY OF THE INVENTION

The invention relates to the field of protective helmets for contact and impact sport such as football.

The invention shows a flexible support brace for transferring excessive backward motion of the helmet directly into the shoulder harness and shoulder pads of a football player's protective equipment, preventing compressive overload of the cervical region of the spine during backward motion of the helmet.

Any successful sports' helmet protective device must permit the player free normal movement of the head including the ability to look down, and within limits of maximum spine compression look upward as well as freely and readily turn the head from side to side in rapid motions, as required during broken field running and other responses.

The invention shown here permits such free motion of the helmet within basic limits by providing a helmet having a spherical external configuration and having two spherical semi-circumferential support bands which enclose a neck protective brace member which is not directly connected to the band but is captured between them so that the helmet may freely move between in rotation and in pitch between certain limits. Within the neckband is provided an engaging stop, captured between the support bands. So long as the helmet circumferential support bands do not contact the engaging member, the helmet is free to rotate and there is substantially no friction or resistance from the neck brace member which is also curved to match the circle curvature of the helmet and the circumferential support bands. Should that helmet be driven in a rearward direction an excessive amount however, the upper circumferential support band will contact the engaging member and substantially all the force applied to the helmet thereafter will be directly driven through the neck brace member downward into shoulder braces which are fastened to the padded shoulder protectors in a football player's uniform.

It is preferable that these forces be transferred into the muscular area of the back on both sides of the shoulder blades, and not to the spine as this muscle area is the most impact resistant area of the upper body.

In order to permit the helmet to be extended forward as is required for a player to look down, an impact absorbing extension link is provided within the neck brace member and also alternatively within the shoulder brace members allowing the overall protective apparatus to be extended and the head is tilted forward but linking up and resisting compression with the helmet is brought back more than a certain amount.

So long as the player's helmet is not moved beyond the limits of safety there is no direct contact between the neck brace member and the helmet or the circumferential support bands and thus a player is freely able to move his head as though no bracing member were attached to the helmet at all. This also substantially eliminates the weight upon the head of the player from the prior art protective devices within the helmet; the entire weight of the protective mechanism is carried on the shoulders and does not increase the muscle loading on the neck muscles of the player.

It is thus an object of this invention to disclose a neck protective brace for use with a football helmet and football player's uniform which does not substantially increase the weight of the helmet or headgear of the football player.

It is a further object of this invention to disclose a protective brace for a football player which permits free motion of the helmet and the head of the player in rotation and in looking up and down within normal range of motion of the human head.

It is a further object of the invention to disclose a protective mechanism for a football player's helmet which prevent overcompression of the cervical spine.

It is a further object of this invention to show a protective brace for a football player's helmet which transfers excessive rearward motion of the helmet directly into the shoulders and back of the player, unloading the cervical spine from excessive compressive forces.

It is a further object of this invention to show a protective neck support for a football player which permits free normal range of the head but prevents excessive rearward motion of the head under impact blows.

These and other objects of the invention may be more clearly seen from the detailed description of the preferred embodiment which follows.

DETAILED DESCRIPTION OF THE PREFERRED EMBODIMENT

Figure 1:
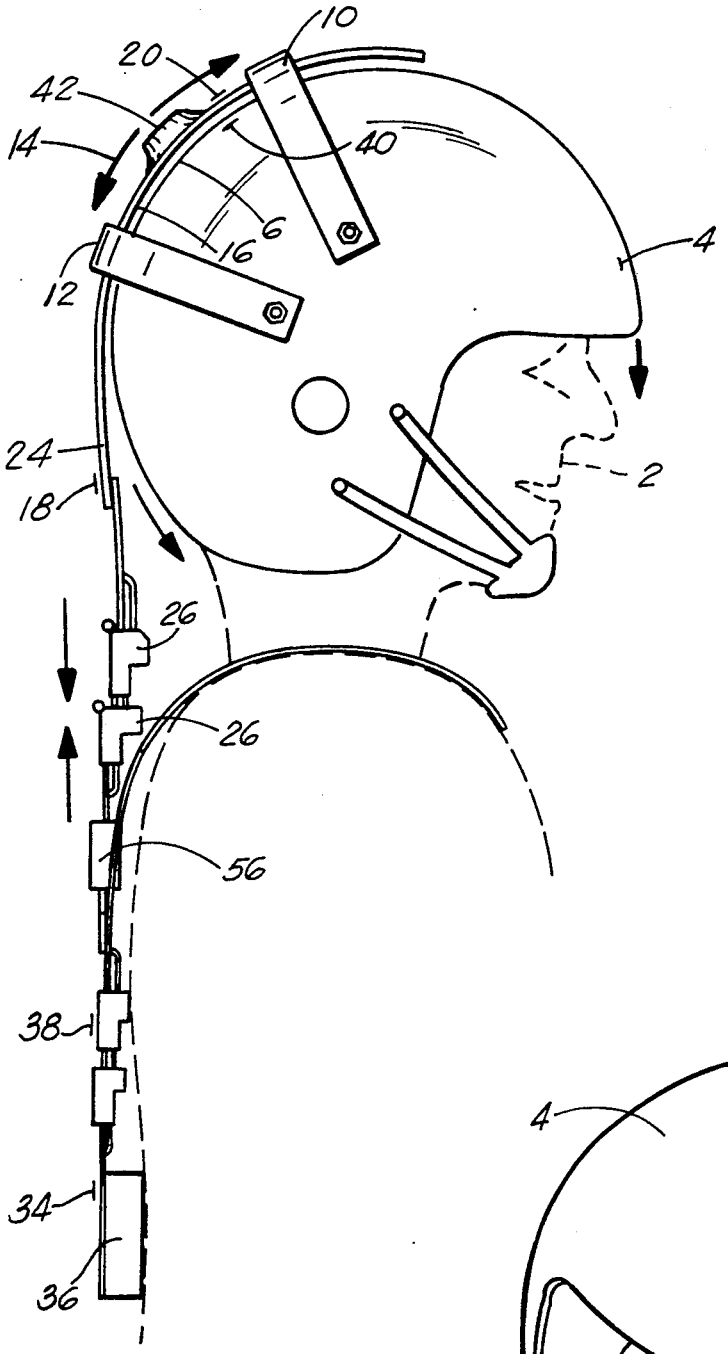
FIG. 1 is a side view of the helmet and protective brace of the invention.
Figure 3:
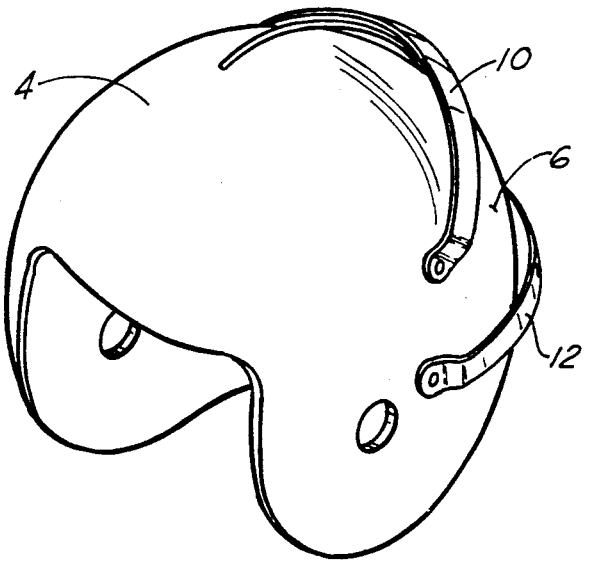
FIG. 3 is a perspective view of the helmet of the invention.
Figure 2:
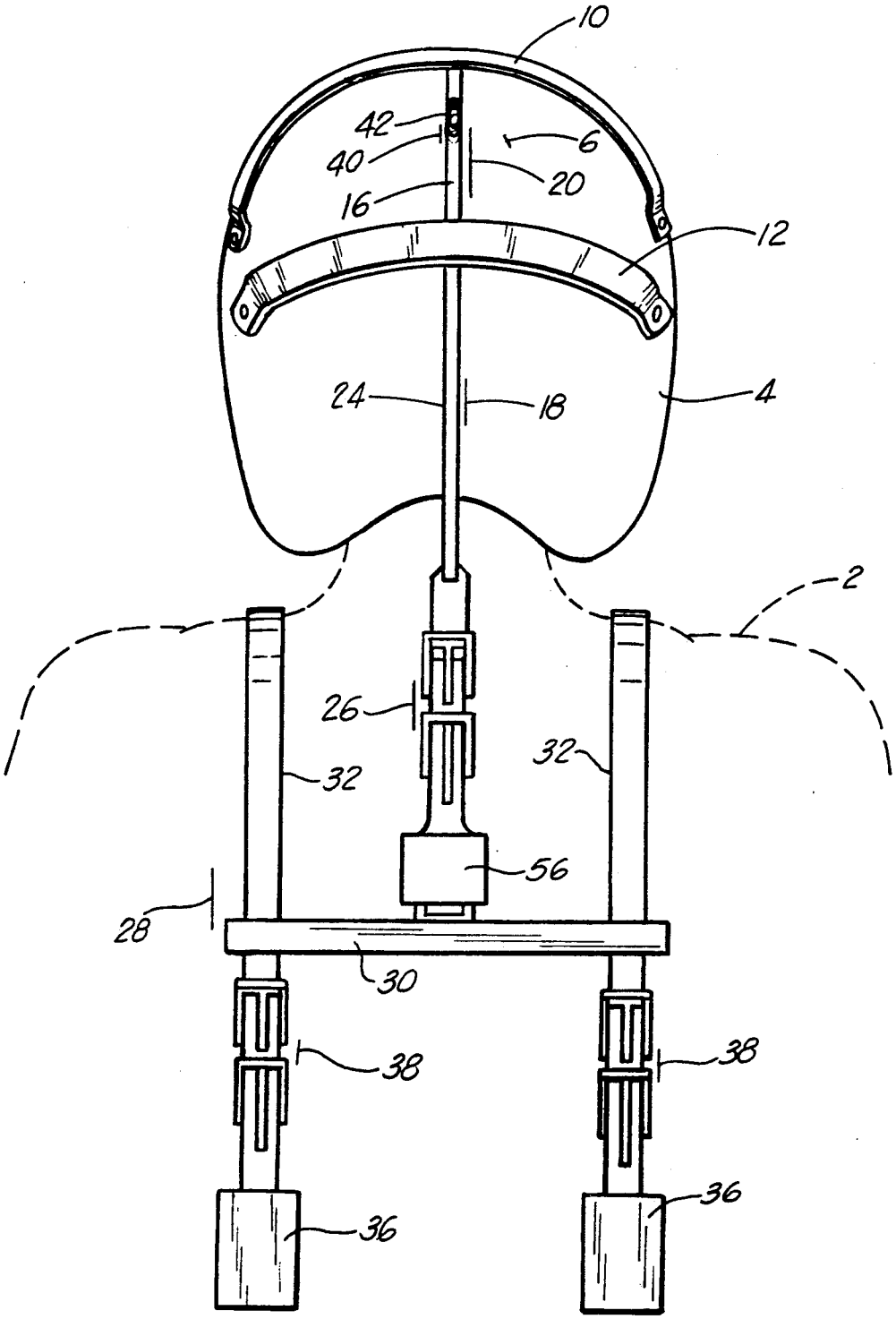
FIG. 2 is a rear view of the protective brace and helmet of the invention.

Referring to FIG. 1 we show a typical football player 2 wearing a rigid protective helmet 4 as is known in the art. The particular helmet 4 of the invention has however a spherical rear section 6. Fixedly mounted to this rear section and extending circumferentially across it having a slightly greater spherical radius 8, but concentric to spherical rear section 6, are a forward circumferential support band 10 and a lower rear circumferential support band 12 defining between them an arc of movement 14 of the helmet 4. The two circumferential support bands 10, 12 and the spherical form of the helmet 4 are preferably concentric with the rotation of the head of the player 2.

Extending vertically along a circumferential arc 16 between the outer surface of the helmet 4 but captive between the circumferential support bands 10, 12 is a neck brace member 18 having an upper, spherically arced captive section 20, and a lower straight neck section 24 which connects through an extension link 26 to a shoulder brace member 28.

In turn the shoulder brace member 28 preferably comprises a cross bar 30 which then extends downward through parallel left and right shoulder members 32 to a point of attachment 34 on or attached to shoulder pads 36 as known in the prior art.

Preferably extension links 38 are provided within the left and right shoulder members 32 intermediate the cross bar 30 and the shoulder pads 36.

The upper captive section 20 of the neck brace is not affixed to or fastened to either the helmet 4 or the circumferential support bands 10, 12 but freely slides within the circumferential support bands 10, 12 by reason of having an arc 16 concentric with the circumferential support bands 10, 12 on the helmet 4. Located at a point 40 on the neck brace member 18 which is intermediate the forward circumferential support band 10 and the rear lower circumferential support band 12 is an engaging block 42, a welded block or tab of sufficient size that it cannot pass between either circumferential support band 10, 12 and the helmet 4.

Figure 4:
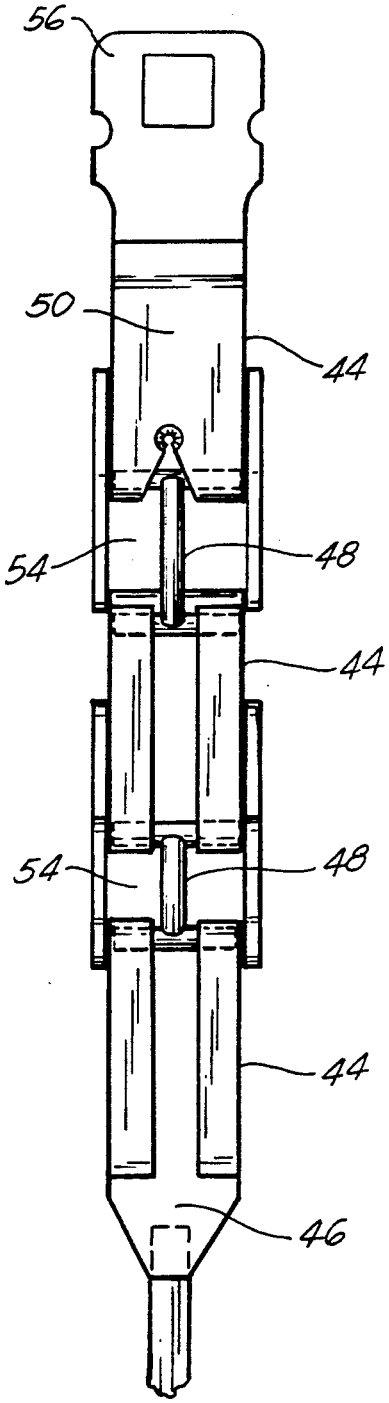
FIG. 4 is a back view of the flexible extension links of the invention.
Figure 5:
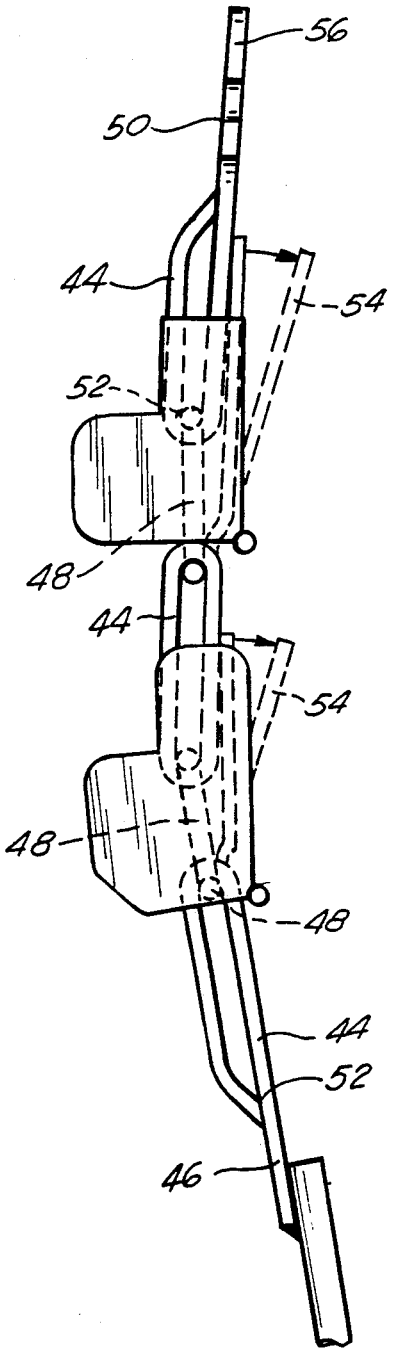
FIG. 5 is a side view of the flexible extension links of the invention.

Referring to FIGS. 4, 5, a typical extension links 26, 38 may be seen to be an interlocked section of an enclosed oval link 44 rigidly affixed to a lower member 46 and holding captive within the oval link 44 a T-bar section 48 rigidly affixed to an upper member 50. Lower member 46 and upper member 50 may be parts of the neck brace 18 or the shoulder braces 28, or may be additional extension links 26. Thus the upper member 50 may close in against lower member 46 until the T-bar section 48 engages contactingly the lower end 52 of the oval 44 in which it is captive; At this point extension 38 link becomes rigid and may not be further compressed. Alternatively, upper member 30 may be extended until the T-bar section 48 is captive at the upper end 54 of oval link 44, at which point further extension will not occur.

The total amount of compression and extension possible is a function of the length of the oval link 44. Support lips 54 extend from the upper member 50 downward on at least one side of the oval link 44 so as to prevent folding of the upper member 50 and lower member 46 about the T-bar 48. Thus the extension link 26, 38 may be extended or shortened but will not fold.

Optionally, it has been found convenient to provide a detachable link 56 within the lower straight section 24 of the neck brace 18 to permit easy removal of the helmet 4. A suitable such detachable link 56, which does not compromise the strength or integrity of the neck brace 18 is one that has neither expansion nor bending capability. Such a detachable link can be readily obtained by welding a section of a standard automotive seat beltlink within the lower straight section 24 of the neck brace. Such links are commonly available, are designed to withstand significant impact loading without failing, bending or breaking, and yet easily released. Both ends of the standard automotive seat belt fastener are metal for strength and may be easily welded into place within lower straight section 24.

It should be apparent that this is simply a preferred form for providing an extension link 26, 38 which has definite extension and compression limits, but is restrained in its motion so as to only move along one direction and not to rotate or otherwise freely move.

In use, the football player 2 may freely move his head so long as the motion is not sufficient to bring the engaging block 42 in contact with either the forward 10 or rear 12 circumferential support band. By making the circumferential support bands 10, 12, the helmet 4, and the upper captive section 20 of the neck brace member as spherical arced sections concentric to an imaginary point of rotation of the head, there is no binding or friction during this movement and the football player 2 is essentially unaware of the existence of the brace 18. The entire weight of the brace 18 rests through the extension links 26, 38 onto the shoulder pads 36; it does not add to the weight of the helmet 4.

If a blow is impacted onto the helmet 4 or a force imposed which would tend to pull the helmet 4 backwards sufficiently to impose compressive loads upon the cervical vertebrae, the engaging block 42 binds on the circumferential support band 10, 12 and the forces upon the helmet 4 are then rigidly transferred through the support band 10, 12 via the engaging block 42 to the neck brace member 18, thence downward through the collapsed extension links 26, 38, the cross bar 30, the shoulder braces 28 and shoulder pads 36, into the muscular area of the back underneath the shoulder pads 36. The neck brace 18, extension links 26, 38 and shoulder braces 28, become a non-flexing, rigid bar under such compressive loads, directly transferring all forces into the shoulder pads, preventing excessive compressive loads upon the cervical vertebrae.

It is to be noted that when the head 2 moves forward an actual extension occurs within the cervical vertebrae. To permit this extension to be matched by the neck brace 18, the extension links 26, 38 permit the neck brace member 18 and the two shoulder braces 28 to extend matching forward movement of the until the engaging block to engage the lower rear circumferential support band. The length of the oval within the extension link or the maximum aligned extension of the extension links is chosen so that the maximum forward motion of the helmet does not exceed the permissible forward motion of the head, which is beyond a chin resting on chest position. Should excessive forward forces be imposed on the helmet 4, then the extension links, having reached their maximum extension, become locked under tension; again all forces exerted on the helmet 4 beyond that point are transferred to the shoulder pads 36 and shoulder braces of the football player. It should be noted that typical shoulder pads 36 and shoulder braces are securely fastened to the chest area and rib cage area of a player; this part of the body is the most resistant to impact forces.

It can thus be seen from the preferred embodiment described that the invention discloses a protective linkage which effectively prevents an excessive rearward or forward motion, in extension or in compression, of a football player's helmet 4 under impacts during play, but between these limits provides substantially no resistance to the motion of a football player's head 2, permitting free rotation for turning or looking up or down. When excessive forces are encountered, these forces are transferred around the cervical vertebrae entirely, and are imposed upon the musculature of the rib cage where they may be dissipated over a wider area with less physical damage to the player. This is considered preferable to those prior art devices which merely distribute the forces more widely across the cervical vertebrae or transfer the forces onto a lower section of the spine; such devices do not bypass the vulnerable spine or vertebrae.

It can thus be seen that the invention extends to a wider range of equivalents beyond the specific preferred embodiment shown here. The claims therefore should not be limited to the individual embodiment shown but extend to that wider range of equivalents which will be apparent to those skilled in the art.

I claim:

1. A protective helmet for contact sports comprising:
a spherical outer shell;
a first, upper circumferential band spanning an arc of said shell;
a second, lower circumferential band spanning an arc of said shell;
a compression resistant cervical brace having a arcuate upper end and a lower end;
said arcuate upper end being movably captive between said first and said second bands and said shell;
means on said arcuate upper end to limit motion of said cervical brace with respect to the helmet; and
means fastening said cervical brace lower end to a shoulder protective apparatus.

2: The apparatus of claim 1 further comprising:
said first and said second circumferential bands having a radius;
said shell having a radius;
said band radius and said shell radius being concentric.

3. The apparatus of claim 1 further comprising:
said first circumferential band, said second circumferential band, said shell and said arcuate upper end each defining circular arcs being concentric.

4. The apparatus of claim 1 wherein said lower end further comprises:
means for expanding the length of said cervical brace from a first to a second length.

5. The apparatus of claim 4 wherein said means further comprise:
at least one expandable, bend resistant link and captive pin.

6. The apparatus of claim 4 wherein said means further comprise:
said cervical brace lower end having at least one first and second interconnected, linked sections;
said first linked section having an open oval end;
said second linked section having a T-shaped end captive within said oval end;

finger extensions on said oval end overlapping said second linked section.

7. The apparatus of claim 1 wherein said means fastening said cervical brace lower end further comprise:

a cross bar member affixed to said lower end;

a left shoulder pad engaging member affixed vertically to a left end of said cross bar member;

a right shoulder pad engaging member affixed vertically to a right end of said cross bar member.

8. The apparatus of claim 7 wherein said shoulder pad engaging member further comprises:

a shoulder bracket further comprising:

a curved upper end for engaging a shoulder; and a curved upper end for bracing against a rib cage.

9. The apparatus of claim 8 wherein each said shoulder bracket further comprises:

means, intermediate said curved upper end and said padded lower end, for expanding the length of said shoulder bracket from a first to a second length.

10. The apparatus of claim 9, said means for expanding further comprising:

said shoulder bracket having at least one first and second interconnected, linked sections;

said first linked section having an open oval end;

said second linked section having a T-shaped end captive within said oval end;

finger extensions on said oval end overlapping said second linked section.

11. The apparatus of claim 7 wherein said lower end further comprises: means for expanding the length of said cervical brace from a first to a second length.

12. The apparatus of claim 11 wherein said means further comprise:

at least one expandable, bend resistant link and captive

13. The apparatus of claim 11 wherein said means further comprise:

said cervical brace lower end having at least one first and second interconnected, linked sections;

said first linked section having an open oval end;

said second linked section having a T-shaped end captive within said oval end;

finger extensions on said oval end overlapping said second linked section.

* * * * *